US007806298B2

(12) United States Patent
Kraus et al.

(10) Patent No.: US 7,806,298 B2
(45) Date of Patent: Oct. 5, 2010

(54) MULTI-COMPARTMENT DISPENSING CONTAINER

(76) Inventors: Stephanie Kraus, 2455 E. Chevy Chase Dr., Glendale, CA (US) 91206; Randal Ouye, 3054 Community Ave., La Crescenta, CA (US) 91214

( * ) Notice: Subject to any disclaimer, the term of this patent is extended or adjusted under 35 U.S.C. 154(b) by 1034 days.

(21) Appl. No.: 11/092,459

(22) Filed: Mar. 28, 2005

(65) Prior Publication Data

US 2006/0213926 A1 Sep. 28, 2006

(51) Int. Cl.
*B67D 7/74* (2010.01)

(52) U.S. Cl. ..... 222/129; 222/142.6; 222/181.1; 222/185.1

(58) Field of Classification Search ..... 222/129, 222/184, 185.1, 465.1, 142.6, 132, 144.5, 222/545, 181.1, 186
See application file for complete search history.

(56) References Cited

U.S. PATENT DOCUMENTS 1,660,174 A * 2/1928 Parry et al. ..... 222/129
1,830,144 A * 11/1931 Venago ..... 222/129
2,469,034 A * 5/1949 Garris ..... 222/142.9
4,714,174 A 12/1987 Williams
4,795,052 A 1/1989 Hayes, Jr.
4,801,027 A 1/1989 Hunter
4,915,250 A 4/1990 Hayes, Jr.
4,953,737 A 9/1990 Meyers
5,050,759 A 9/1991 Marble
5,294,018 A 3/1994 Boucher
D371,779 S 7/1996 Nowak et al.
D376,734 S 12/1996 Petrie
D379,495 S 5/1997 Sidman et al.
D383,911 S 9/1997 Conforti et al.
5,669,665 A 9/1997 Nowak
D386,104 S 11/1997 Nowak
D386,703 S 11/1997 Nowak
D387,239 S 12/1997 Johnstone
D389,359 S 1/1998 Nowak
D390,135 S 2/1998 Rossman et al.
D391,407 S 3/1998 Rossman et al.
5,725,117 A 3/1998 Berjis
D394,166 S 5/1998 Rossman et al.
5,755,489 A 5/1998 Rossman et al.
5,761,756 A 6/1998 Nowak et al.
5,763,796 A 6/1998 Britto et al.
5,765,715 A 6/1998 Hughes
5,772,088 A 6/1998 Nelson
D395,832 S 7/1998 Rossman et al.
D396,292 S 7/1998 Nowak
D396,717 S 8/1998 Sidman et al.
5,833,189 A 11/1998 Rossman et al.
D403,842 S 1/1999 Bair et al.
5,871,118 A 2/1999 Franzese
5,890,620 A 4/1999 Belcastro
5,890,627 A * 4/1999 Storey ..... 222/129
5,893,472 A 4/1999 Forrer
D411,349 S 6/1999 Johnstone
D412,292 S 7/1999 Nowak et al.

(Continued)

*Primary Examiner*—Frederick C. Nicolas
(74) *Attorney, Agent, or Firm*—Ference & Associates LLC

(57) ABSTRACT

A multi-compartment dispensing container includes multiple cells arranged around an axis. A common lid is provided. The cells each have an outlet port arranged substantially at the bottom, and each of these cells is isolated, one from the other, so that a substance can be in each cell independently of the other.

16 Claims, 2 Drawing Sheets

U.S. PATENT DOCUMENTS 5,938,053 A 8/1999 Verbovszky et al.
D413,792 S 9/1999 Hotaling et al.
D417,275 S 11/1999 Conforti
5,993,285 A 11/1999 Sofia et al.
5,993,478 A 11/1999 Nowak
D417,914 S 12/1999 Nowak
6,000,750 A 12/1999 Rossman et al.
D419,785 S 2/2000 Conforti et al.
D421,125 S 2/2000 Nowak
D421,126 S 2/2000 Nowak
6,026,528 A 2/2000 Pina
D421,469 S 3/2000 Reinke et al.
6,033,019 A 3/2000 Hession-Kunz et al.
6,037,872 A 3/2000 Dunnum
D422,849 S 4/2000 Knight et al.
6,045,254 A 4/2000 Inbar et al.
6,049,954 A 4/2000 Britto
D424,203 S 5/2000 Nowak
D424,312 S 5/2000 Hotaling et al.
D424,958 S 5/2000 Nowak
D426,300 S 6/2000 Conforti
6,089,653 A 7/2000 Hotaling et al.
D430,052 S 8/2000 Nowak
D430,737 S 9/2000 Nowak et al.
D432,342 S 10/2000 Popek et al.
RE37,016 E 1/2001 Morano
D436,655 S 1/2001 Hotaling et al.
D436,800 S 1/2001 Nowak et al.
6,168,034 B1 1/2001 Perrone
6,176,042 B1 1/2001 Rossman et al.
6,202,247 B1 3/2001 Lorenz, Jr.
6,212,706 B1 4/2001 Rossman et al.
D443,233 S 6/2001 Gaudet et al.
6,253,392 B1 7/2001 Conforti et al.
6,269,968 B1 8/2001 Belcastro
6,322,149 B1 11/2001 Conforti et al.
6,325,236 B1 12/2001 Wong
6,354,708 B1 3/2002 Monahan et al.
D460,322 S 7/2002 Orr et al.
6,412,527 B1 7/2002 Brice
6,415,460 B1 7/2002 Rossman et al.
D461,361 S 8/2002 Orr et al.
D465,423 S 11/2002 Larson et al.
6,478,435 B2 11/2002 Monahan et al.
D467,125 S 12/2002 Orr et al.
6,499,254 B2 12/2002 Rossman et al.
D469,860 S 2/2003 Riemer et al.
6,513,379 B2 2/2003 Meyers et al.
6,536,163 B1 3/2003 Monahan et al.
6,536,502 B2 3/2003 Britto et al.
6,571,981 B2 6/2003 Rohlfs
6,578,209 B2 6/2003 Lopes et al.
D478,669 S 8/2003 Wear
6,640,992 B1 11/2003 Berger et al.
6,648,396 B2 11/2003 Monahan et al.
6,658,678 B2 12/2003 Hotaling et al.
6,658,681 B2 12/2003 Britto et al.
6,673,036 B1 1/2004 Britto
6,692,072 B2 2/2004 Nelson et al.
6,695,678 B1 2/2004 Foley et al.
6,749,582 B2 6/2004 Britto et al.
6,802,757 B1 10/2004 Sejnowski
6,834,400 B2 12/2004 Zanardelli et al.
6,840,918 B1 1/2005 Britto et al.
D502,551 S 3/2005 Hotaling et al.
6,910,594 B2 6/2005 Foley et al.
6,923,337 B2 8/2005 Hession et al.
6,928,674 B2 8/2005 Blackburn
6,954,955 B2 10/2005 Brewin et al.
6,964,572 B2 11/2005 Cesa
6,976,604 B2 12/2005 Connors, Jr. et al.
7,185,788 B2 * 3/2007 Morris ..... 222/129
2006/0283883 A1 * 12/2006 Mika et al. ..... 222/129

* cited by examiner

FIG. 1
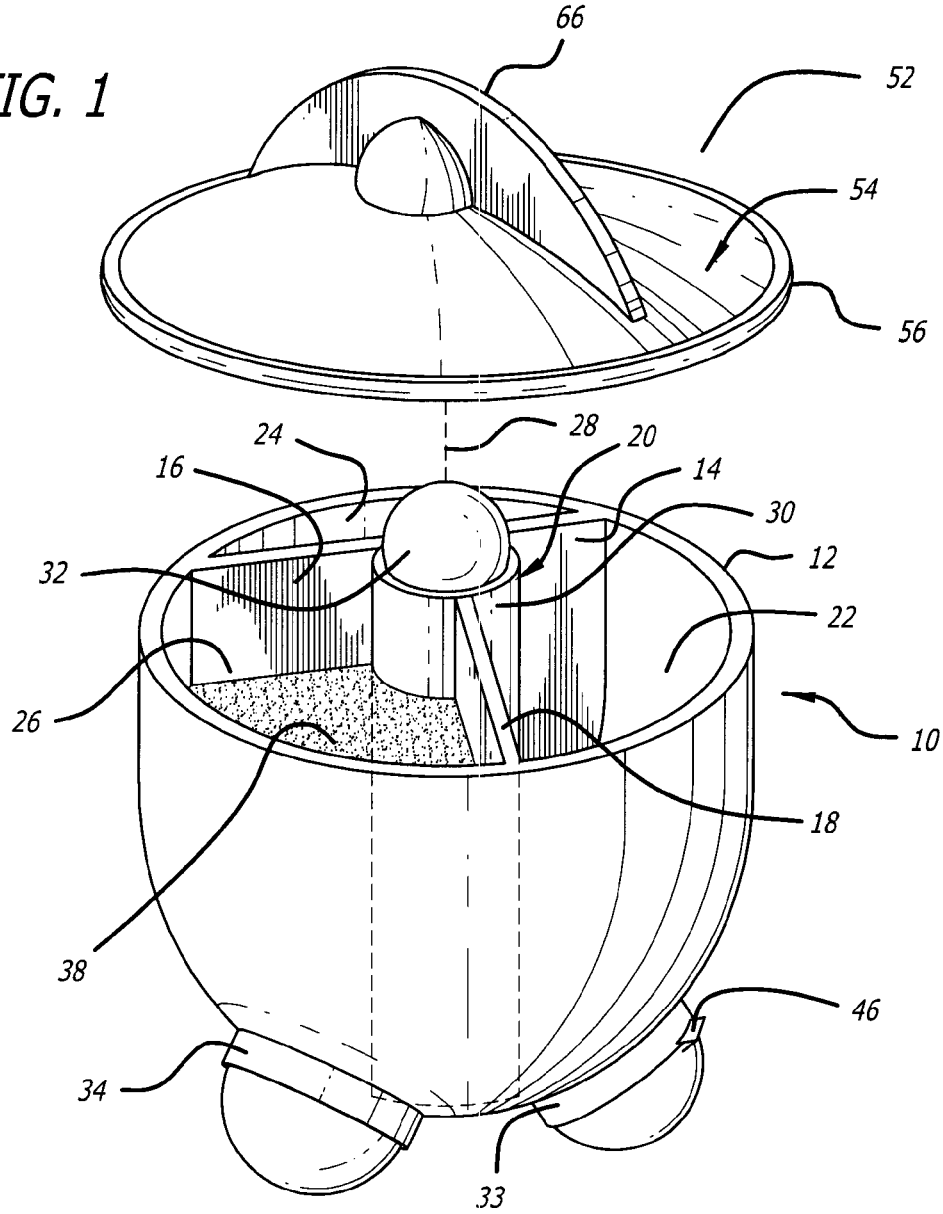
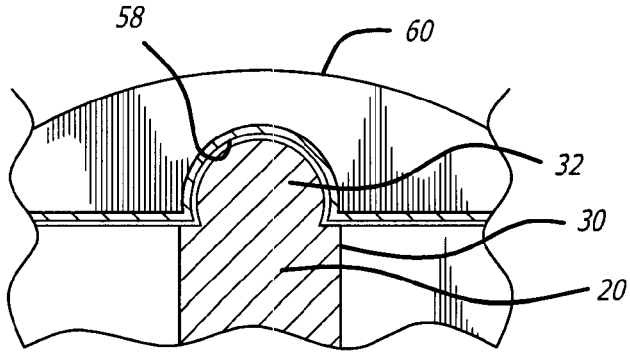
FIG. 4

MULTI-COMPARTMENT DISPENSING CONTAINER

RELATED APPLICATIONS

This application is related to U.S. Utility Patent Application filed on Mar. 28, 2005, entitled "CLEANING UTENSIL FOR A FLUID CONTAINER" Ser. No. 11/091,968; U.S. Utility Patent Application filed on Mar. 28, 2005, entitled "IRREGULAR SHAPED BABY BOTTLE" Ser. No. 11/092,361; U.S. Utility Patent Application filed on Mar. 28, 2005, entitled "A HANDLED DRINKING CONTAINER" Ser. No. 11/091,973; and U.S. Utility Patent Application filed on Mar. 28, 2005, entitled "BABY BOTTLE WITH ENLARGED LOWER PORTION" Ser. No. 11/091,971; all of which have been filed concurrently herewith. The contents of those applications are incorporated by reference herein.

BACKGROUND

1. Field

This disclosure relates to a container for dispensing substances.

2. General Background

Different kinds of containers for dispensing substances are known. In particular, the substances are in the form of powders, such as baby formulas, and/or alternatively the substances can be liquids and/or liquid-solid combinations. These known containers have different features and characteristics. None of these known containers have the advantages, utility and ergonomic characteristics which are desirable for situations such as permitting easy consumer use with good hygienic abilities. It is an object of this disclosure to provide a dispensing container with these advantages.

SUMMARY

A dispensing container includes at least two cells for receiving substances. The cells are separated from each other. There is a closure for each cell and the closure is intended to be at a top location of the respective cells. An outlet for each cell is located towards the bottom of each cell. A lid for each cell secures the contents of each cell in an essentially leak-proof manner.

In one form, the inside face of the cells is relatively smooth without sharp corners, such that the substance can relatively easily exit the cells without getting stuck or clumping on the walls or other parts of the container.

Also, in a preferred form, the lid is common to the openings for the cells. The single lid permits for a large opening to the cells such that the substance can easily be introduced into the cells. As such, when the lid is removed, the access to all cells is obtained. In a preferred form, the cells are arranged about a central axis. Preferably, there are three cells radially arranged around the central axis. There is a common single lid which fits over all the cells.

In some preferred forms, the container is more or less circular, and the outlets are formed as feet for the container.

DRAWINGS

The above-mentioned features and objects of the present disclosure will become more apparent with reference to the following description taken in conjunction with the accompanying drawings, wherein like reference numerals denote like elements, and in which:

FIG. 1 is a perspective view showing the lid above the compartments.

FIG. 4 is a cross section view of the container.

DETAILED DESCRIPTION

Figure 2:
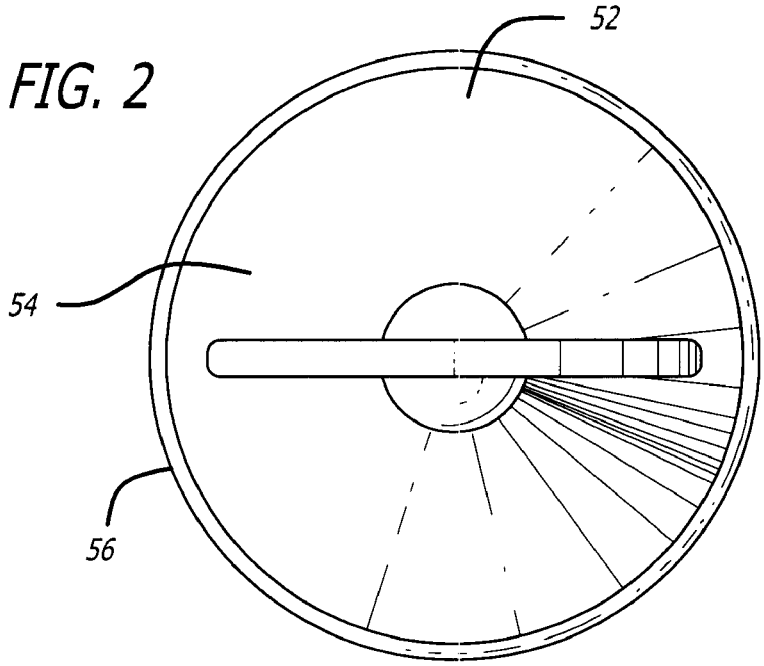
FIG. 2 is a top view of the container lid.
Figure 3:
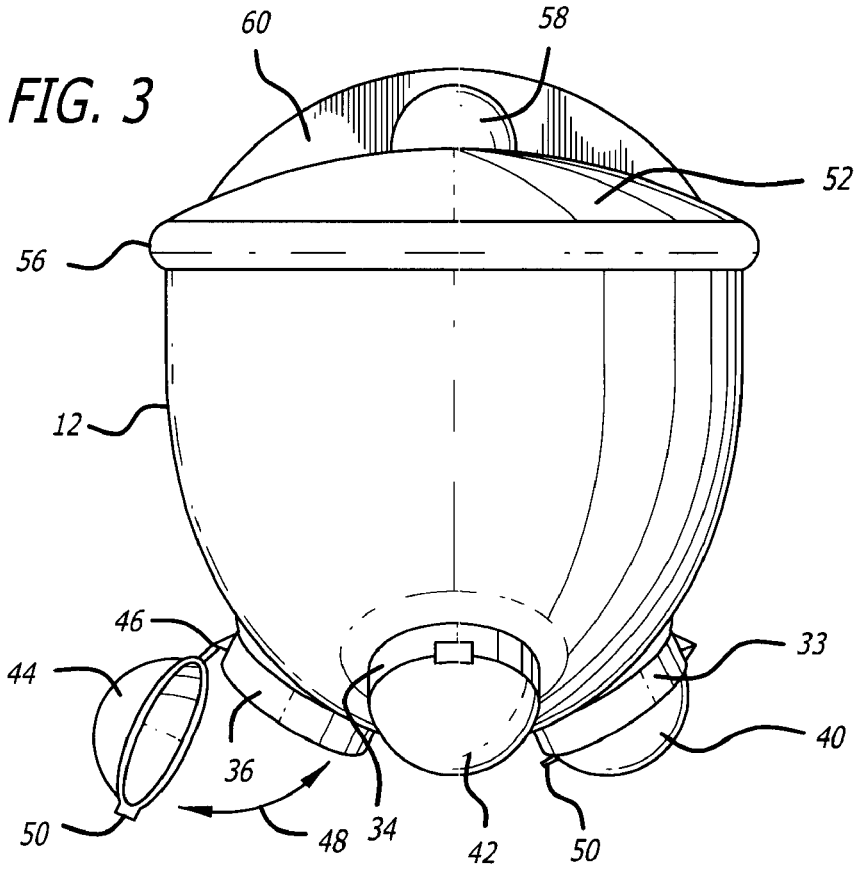
FIG. 3 is a side view of the container with one of the outlets opened.

The device is now described with reference to an example which is not to be considered as limiting. This is purely an illustration of the device.

One of ordinary skill in the art will understand that the present discussion is a description of exemplary embodiments only, and is not intended as limiting the broader aspects of the present disclosure, which broader aspects are embodied in the exemplary construction. A repeat use of reference characters in the present specification and drawings represents the same or analogous features or elements of the disclosure.

A multi-compartment container 10 includes a substantially circular sidewall 12 with divisions 14, 16 and 18 which are radially splayed out from a central core 20. As such, there are three compartments 22, 24 and 26 which are formed radially about a central axis 28. The core portion 20 includes an upstanding column 30 and on the topmost portion of the column, there is an essentially circular ball-like structure 32. The base of the column 20 is integrally formed with the sidewall 12 and mates with the base of the shell of the container.

Arranged circumferentially around the base or bottom area of the container are three outlets 33, 34 and 36. Each of these outlets includes an outlet port or spout from which the substance, in the form of baby formula powder, such as indicated by numeral 38 in any one of the cells, can exit from the respective cell when the respective outlet is opened. The substance can empty essentially completely from the container under gravity when the container is upright. Each of the ports 33, 34 and 36 has respectively a cap 40, 42 and 44 which is hinge mounted as indicated by numeral 46 so as to move between an open and closed position as indicated by arrow 48.

The inside face or wall of the container as defined by the cells is relatively smooth and formed to slope gradually towards the outlets when upstanding. The interface with the outlets is gradual and has the minimum of sharpness so as to facilitate the outflow of the powder for the cells when the outlets are opened.

When in the closed position, each of the cells is effectively closed such that substance cannot exit from the outlets. A finger grip 50 can be provided on the opposite side of the hinge if necessary to facilitate the release or otherwise of the cap from the closure port.

The lid 52 is provided with an essentially circular member 54 which has a rim 56 which engages on the outside of the wall 12 to retain a leak-proof configuration between the lid and the container for the cells. The opening to the cells is relatively large and essentially is formed by the perimeter wall of the cells.

The inside of the lid 52 has a hemispherical void 58 which mates with the hemispherical section 32 so that a positive engagement is attained when the lid 52 is put in place on the top of the wall 12 of the container. The outlet for each cell includes a movable cap. The cap inside forms essentially a hollow hemispherical shape such that in a closed position with formula in the cell, formula can fill part of the cap. When opened the formula can drain under gravity from the opened cap, and in this sense the opened cap is directed so as that the open hemisphere is downwardly directed.

Arranged in radial or diametric form over the hemispherical section 58 is a handle 60 which is radially directed from essentially one side of the lid to the other side of the lid. This permits for effective removal of the lid from the top of the container as necessary. The rim 56 may screw down on the top of the threaded section at the top of the container or alternatively an appropriate clip configuration can be used.

A unitary multi-compartmented dispensing container for a baby formula powder-like substance comprises three cells, each cell having an internal wall essentially sloping downwardly towards an outlet. The cells receive the baby formula, and each cell is separated from the other cell. The outlet for each cell is at a bottom of each cell. There is an interface between the wall for each cell and the outlet, and is such that the low point of the outlet interface and the base of the cell is substantially in horizontal alignment when the container is located in an upright position.

The walls of the container may be in part transparent and in part opaque. The transparency characteristic permits for outside visualization of the contents in the container.

The three cells can be pre-filled with baby formula and each, in turn, can be emptied through the respective outlets. Suitable indicia can be provided to permit a user to see visually the fullness of each cell. The outlets are of a nature such that effective draining under gravity is easily achieved. There can be more than three cells arranged around the central axis.

The feet outlet configurations provide a useful structure for ensuring the upright location of the container and at the same time a simple way to effect drainage of contents in the cells as needed. The configuration thus provides a dual purpose.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A dispensing container comprising:

a convex curved outer wall defining a bowl shaped cavity therein having an open top;

a plurality of inter walls dividing the cavity into at least two cells for receiving a substance;

a lid configured to enclose the open top;

each cell having an outlet located at a bottom of the cell, such that the substance in the cell can empty from the container through the outlet under gravity, wherein the outlet forms a portion of a support for the container; and a closure for each outlet.

2. A container as claimed in claim 1, wherein the lid is common for all of the cells.

3. A container as claimed in claim 1, wherein the cells are located symmetrically about a central axis.

4. A container as claimed in claim 1, wherein there are at least three cells, the cells being radially arranged about a central axis of the container.

5. A unitary multi-compartmented dispensing container for a substance comprising:

three cells for receiving the substance, each cell being separated from every other cell and radially arranged about a central axis of the container;

a lid configured to enclose said each cell, the lid being intended to be at a top location of the cell;

an outlet located at a bottom of said each cell constituting a support leg for the container in that the container is locatable in an upright manner when located with the outlets directed downwardly, such that the substance can empty from the container under gravity; and a closure for the outlet of said each cell for securing the substance of said each cell, wherein the closure in a hinged cap on the outlet.

6. A unitary multi-compartmented dispensing container comprising:

a convex curved outer wall defining a bowl shaped cavity therein;

a plurality of internal walls dividing the cavity into at least two cells, each cell having at least one internal wall sloping downwardly towards an outlet, and said each cell being separated from every other cell by one or more of the internal walls;

a lid configured to enclose said each cell, the lid being intended to be at a top location of the cell;

the outlet for said each cell being located at a bottom of the cell and forming at least part of a support leg for the container, such that a substance in the cell can empty from the container under gravity; and a removable cap on the outlet of said each cell for securing the substance in the cell.

7. A container as claimed in claim 6, wherein the lid is common for all of the cells.

8. A container as claimed in claim 7, wherein the cells are located about a central axis.

9. A container as claimed in claim 6, wherein the cap inside surface has a hemispherical shape such that in a closed position the substance located within the cell will fill part of the cap.

10. A unitary multi-compartmented dispensing container for receiving a substance comprising:

a convex curved outer wall defining a bowl shaped cavity therein having an open top;

a plurality of internal walls dividing the cavity into a plurality of cells, each cell of the plurality of cells being separated from every other cell of the plurality of cells;

said each cell having an outlet located at a bottom of the cell, and wherein each outlet is adapted to form a portion of a support leg for the container; and a cap on said each outlet of said each cell for securing a substance in the cell, wherein the cap has an inside surface shape such that in a closed position with the substance in the cell, the substance can fill at least part of the cap.

11. A unitary multi-compartmented dispensing container for receiving and holding a substance comprising:

a plurality of separate cells joined together about a central axial core, each cell having an outlet forming a portion of a support leg for the container, wherein the outlet is located at a bottom of that cell; and a cap on each outlet of said each cell for retaining a substance in the cell, wherein the cap has a concave curved inside surface shape such that in a closed position with the substance in that cell, the substance can fill at least part of the cap.

12. A dispensing container comprising:

a bowl shaped curved outer wall symmetrical about a cylindrical axial core defining a cavity therebetween and an open top;

a plurality of spaced inner walls extending between the outer curved wall and the core separating the cavity into cells arranged about the core;

each cell having a bottom outlet through the curved wall forming a container support leg spaced from the straight inner walls for passage therethrough of substance contained within the cell; and a removable cap closing each of the outlets wherein the cap forms a support portion of the support leg.

13. The container according to claim 12 wherein the outlet of said each cell is formed by a cylindrical tube projecting downward and outward from the outer wall and the cap is a hollow semispherical cap attached to the cylindrical tube by a hinge.

14. The container according to claim 12 wherein the central core has a spherical end portion.

15. The container according to claim 14 further comprising a lid shaped to engage one or more of the curved outer wall and the end portion of the central core to close the open top of the container.

16. The container according to claim 12 wherein the plurality of walls form three separate cells.

* * * * *